United States Patent [19]

Smith

[11] 4,079,727

[45] Mar. 21, 1978

[54] VENTING SYSTEM FOR A GAS-FIRED HEATING PLANT

[75] Inventor: Donald Leon Smith, Palos Hills, Ill.

[73] Assignee: Thrifty-Vent, Inc., Salem, Ill.

[21] Appl. No.: 747,305

[22] Filed: Dec. 3, 1976

Related U.S. Application Data

[63] Continuation-in-part of Ser. No. 580,133, May 23, 1975, Pat. No. 4,009,705.

[51] Int. Cl.[2] ..... F23J 11/02

[52] U.S. Cl. ..... 126/307 A; 98/48; 126/312; 431/20

[58] Field of Search ..... 126/307 R, 307 A, 312; 110/47, 162; 98/48; 431/20

[56] References Cited

U.S. PATENT DOCUMENTS

| | | | |
|---|---|---|---|
| 886,391 | 5/1908 | Moore | 126/307 A |
| 1,837,581 | 12/1931 | Peterson | 126/312 |
| 1,840,628 | 1/1932 | Howle | 126/307 A |
| 2,002,020 | 5/1935 | Nyborg | 126/312 |
| 2,486,780 | 11/1949 | Fenberg | 126/307 A |
| 2,698,140 | 12/1954 | Buehler | 431/20 |
| 2,937,697 | 5/1960 | Johnston | 431/20 |

*Primary Examiner*—Ronald C. Capossela
*Attorney, Agent, or Firm*—Mawhinney & Mawhinney & Connors

[57] ABSTRACT

A venting system for the combustion chamber of a gas-fired heating plant has an elongate diverter box arranged vertically of the heating plant exteriorly thereof and having an upper portion and a lower portion with the latter having a bottom provided with a substantial opening disposed well above the base of the heating plant for the free admission of atmospheric air surrounding the heating plant into the diverter box and with the upper portion having selected openings for the reception of horizontally disposed pipings from the flue outlet for the combustion chamber and for the chimney flue with a vertical baffle depending from the closed top of the upper portion a substantial vertical extent into the diverter box and dividing it into a flue outlet section and a chimney flue section with said sections having thermostat means to indicate exteriorly of the sections the temperature of the gases therein and with a safety limit switch housed in the flue outlet section below the lower free end of the baffle and being protected by a barrier plate from cold down drafts from the chimney flue.

9 Claims, 4 Drawing Figures

VENTING SYSTEM FOR A GAS-FIRED HEATING PLANT

The present application is a continuation-in-part of application Ser. No. 580,133, filed May 23, 1975 now U.S. Pat. No. 4,009,705.

BACKGROUND OF THE INVENTION

1. Field Of The Invention

The present invention appertains in general to new and novel improvements in gas-fired heating plants, such as warm-air furnaces, boilers and the like, and particularly relates to a new and novel system for venting such heating plants.

2. State Of The Art

Known venting systems function to carry off the fumes or products of combustion, which contain carbon monoxide, from the flue opening in a gas-fired heating plant to the chimney flue. The venting systems incorporate a back-draft diverter which is built adjacent to the combustion chamber of the heating plant and disposed within the jacket of the heating plant and which functions to prevent a back draft from blowing out the pilot light in the combustion chamber.

In such conventional vented installations, the gravity of the heat in the top of the combustion chamber allows the heated air to rise out through the chimney flue and to be replaced through the fresh air inlet by cool air, thus cooling off the combustion chamber. Such venting systems permit a considerable loss of heat which escapes up through the chimney flue.

Draft hoods or regulators have been used to prevent the occurrence of down drafts through the chimney into the combustion chamber of the heating plant. But such draft hoods or regulators also tend to reduce the temperature within the combustion chamber for the heat within the combustion chamber is drawn off or allowed to escape through the chimney flue and, consequently, more combustion of fuel is required to raise the temperature within the combustion chamber.

None of the known venting systems deals with the dual problem of conservation of fuel while realizing a safe installation and operation in warm-air furnaces and gas-fired boilers. In conventional methods of venting a gas-fired heating plant, the gravity of the heat in the top of the combustion chamber always permits the heat to rise out of the chimney flue and be replaced in the fresh air inlet at the main burners by cold air. This cools off the combustion chamber.

Furthermore, internal baffle means are utilized only as back-draft diverters and none of these serve to form a heat lock within the combustion chamber so as to hold high temperature heat within the combustion chamber until the heat exchanger gives the heat off for use.

In addition, none of the venting systems reduce the flue vent pipe temperature. And overheated vent pipes cause most, if not all, flue fires. Also, known venting systems do not take into account flue stoppages which block up the chimney flue.

Further, previous fuel saving venting systems do not meet the standards set by the American National Standards Institute For Fire Protection and the American Gas Association and are not adaptable for use in the limited furnace space usually found in modern home installations.

SUMMARY OF THE INVENTION

An important object of the present invention is to provide a venting system for a gas-fired heating plant whereby considerable savings in gas consumption can be realized, backdrafts to the pilot light can be prevented, flue pipe temperatures can be reduced and dangers fraught with flue stoppages can be eliminated.

A further important object of the present invention is to provide an improved economical, simple but highly effective venting system for a gas-fired heating plant, which system will serve to divert back drafts and to lock-in the heat inside the combustion chamber of the heating plant.

A further important object of the present invention is to provide an improved venting system that can be used with modern warm-air furnaces having factory installed internal diverters or gas-fired boilers having factory installed draft hoods and that can meet the safety standards set by government regulatory agencies and trade associations.

Another object of the present invention is to provide an improved venting system that cools the fumes emanating from the combustion chamber of a gas-fired heating plant so as to reduce the temperature of the vent pipe and thereby prevent flue fires and to provide an improved safety arrangement which will respond to higher than normal temperatures of the fumes, such as occurring in the instance of blocked flues, to shut off the main burners for the heating plant.

Generally considered, the present invention provides in combination with a gas-fired heating plant, a venting system for the combustion chamber thereof which includes horizontally disposed pipings extending straight out from the flue outlet of the heating plant and the chimney flue and which are interconnected and intercommunicated by the upper portion of an elongate diverter box that is vertically oriented alongside and disposed exteriorly of the heating plant and has a vertical baffle dividing the upper portion into a flue outlet section and a chimney flue section with such sections being provided with temperature indicators. The bottom of the elongate diverter box is completely open or is provided with a substantial opening for the ingress of cold atmospheric air into the diverter box. The gases coming into the diverter box at its upper end portion from the heating plant flue outlet arrive on one side of the baffle and the cold air establishes a cold air pressure head within the flue outlet section below the inlet of the piping from the flue outlet of the heating plant to establish a heat lock and prevent the flow of heated air from the combustion chamber of the heating plant. The cold air also acts in the chimney flue section to prevent down drafts from the chimney flue attempting to pass down through the chimney flue section from reaching the combustion chamber of the heating plant.

A safety limit switch is housed in the lower end of the flue outlet section of the diverter box and is intended to be activated by a rise in temperature of the fumes so as to act through the thermostat circuit and close the gas valve to shut off the flow of gas to the burner of the heating plant. A barrier plate is positioned across the lower end of the diverter box in front of the safety switch to prevent any cold down draft from coming into contact therewith and neutralizing its operation.

DESCRIPTION OF THE PREFERRED EMBODIMENT

Figure 2:
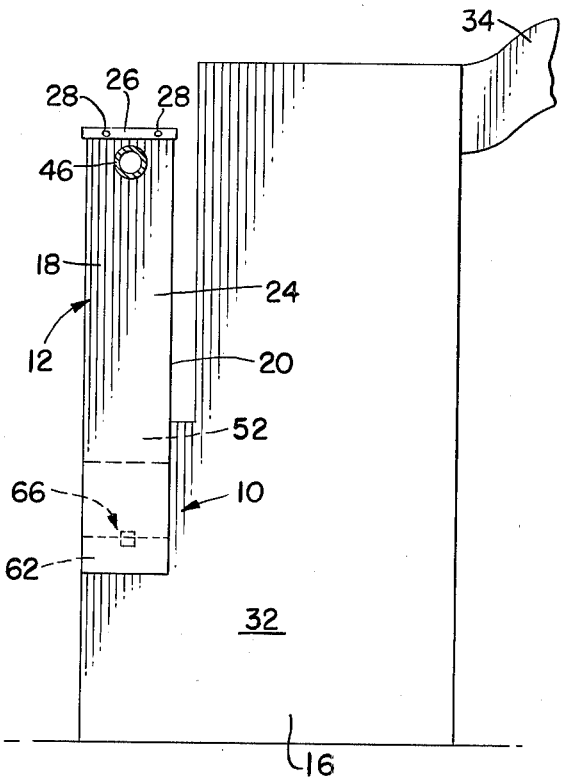
FIG. 2 is a side elevational view of the furnace and venting system of FIG. 1 and is taken on the lines 2—2 of FIG. 1.
Figure 3:
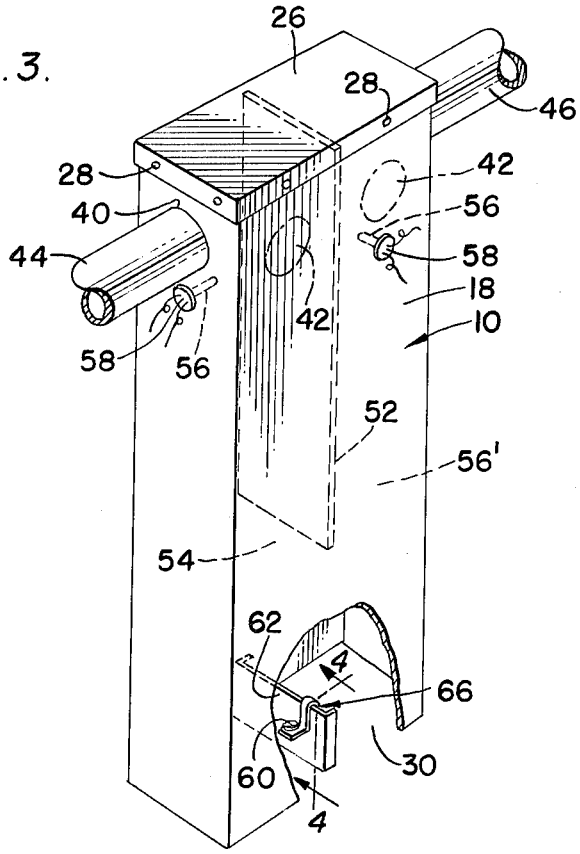
FIG. 3 is a perspective view of the venting system, per se, shown apart from the furnace.

Referring now more particularly to the accompanying drawing, and initially to FIG. 3, the venting system 10 includes an elongate substantially rectangular diverter box 12 which is fabricated from 24 gauge galvinized iron or other sheet metal. The diverter box in use, as shown in FIGS. 1 and 2, is arranged vertically and attached by suitable means to the outside casing 14 of a warm-air furnace 16 or other type of gas-fired heating plant.

The diverter box is composed of opposing vertical side walls 18 and 20 and opposing vertical end walls 22 and 24. The top of the box is open and closed off by a removable lid or cover 26 having side and end flanges that fit over the upper edges of the side and end walls of the box and to which they are releasably fastened by metal screws 28. The bottom 30 of the bottom is completely open or it may be somewhat closed and formed with a substantial opening for the ingress into the box of atmospheric air.

Figure 1:
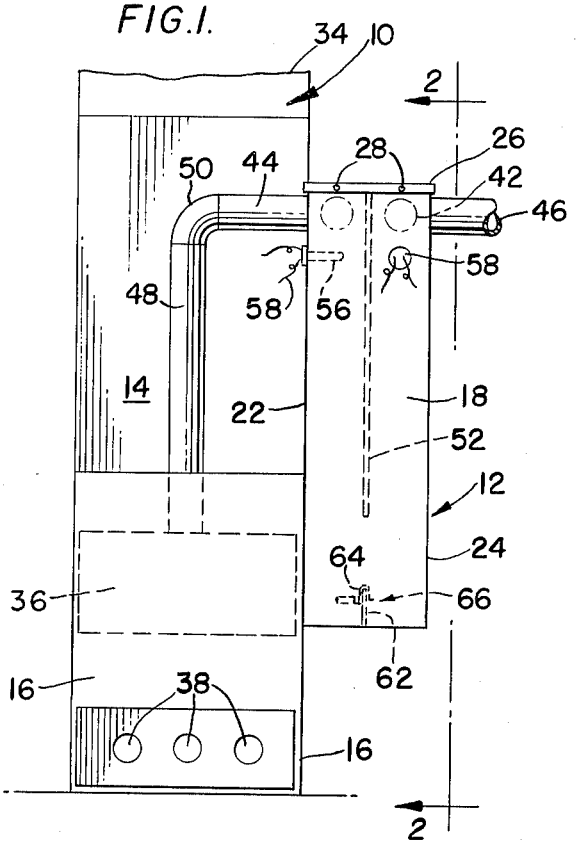
FIG. 1 is a front elevational view of a gas-fired heating plant, such as a typical warm-air furnace, equipped with a venting system in accordance with the present invention.

Having reference to FIGS. 1 and 2, the warm-air furnace 16 is of modern conventional construction and includes a jacket 32 containing a burner compartment, composed of the pilot and main burners, a heat exchanger, a blower compartment and suitable openings in the jacket for supply ducts 34 and return ducts. The furnace has a factory installed, built-in draft diverter 36 shown in dotted lines in FIGS. 1 and 2. The factory diverter 36 has an open bottom and flue outlets open thereinto. Usually, there is a flue outlet for each main burner 38 so, if there are the usual three burners 38, then there are three flue outlets, as exemplarily shown in FIG. 1.

The first step that is taken in the installation of the venting system 10 of the present invention is to seal off tight the open bottom of the factory diverter 38 so that it becomes a collection box. Then, the diverter box 12 of the present invention is attached to the outside of the furnace jacket 32, as shown in FIGS. 1 and 2. The open bottom diverter box 12 is vertically positioned so that its open bottom 30 is at the same elevation as the factory diverter 36. It is important that the diverter box 12 be positioned so that it has its open bottom 30 lying in a horizontal plane above or, at least, in the same plane in which the bottom of the factory diverter lies. This is important so that sufficient oxygen enters the diverter box 12 through the open bottom. The proper amount of entering oxygen will keep the carbon monoxide in the fumes from getting dirty and will create the heat lock in the combustion chamber with the fumes being clean and the fumes in the diverter box becoming cooler and flowing out to the chimney flue, which is thereby cool. Thus, the generated heat is retained inside the combustion chamber of the furnace until the heat exchanger gives off the heat through the warm air supply duct to the rooms in the building.

As can be seen, the diverter box 12 is provided in the upper end portions of its side and end walls with potential openings 40 in the form of scribe or score lines 42 that indicate where the actual openings (preferably circular) should be cut on the job. The openings are made to accommodate the installed ends of horizontally disposed pipes 44 and 46. The pipe 46 extends straight out from the box to the chimney flue (not shown) while the pipe 44 extends straight into the box from the vertical pipe section 48 connected to the top of the furnace. The pipe 44 is attached to the vertical flue outlet pipe section 48 by an elbow 50. The pipes 44 and 46 are so attached to the opposing end walls 22 and 24 of the diverter box, as shown, or the side walls 18 and 20, as can be appreciated, in a way so that they are substantially coplanar and enter the upper portion of the diverter box in an opposing manner.

The opposing openings 42 for the opposing pipes 44 and 46, whether in the side walls or in the end walls as shown in FIG. 3, are separated by a baffle plate 52. The plate 52 is formed from asbestos or other heat resistant material and is positioned vertically in the diverter box 12, in the manner shown in FIG. 3. The baffle plate extends between the side walls in the instance of the pipes 44 and 46 coming into the end walls, as shown in FIG. 3. It has its side edges suitably secured to the inner surface of the side walls centrally of the box or midway between the end walls. The upper end of the baffle plate is in gas tight engagement of the lid or cover 26 while the side edges thereof are in gas tight engagement of the side walls. The lower free end of the baffle plate terminates above the open bottom 30 but the baffle plate extends more than half the vertical extent of the diverter box or approximately three quarters of the vertical extent.

The baffle plate divides the diverter box 12 into a combustion flue section 54 and a chimney flue section 56′ with the combustion flue section 54 being communicated with the pipe 44 and receiving therefrom the combustion gases from the combustion chamber of the furnace while the section 56′ is in communication with the chimney flue pipe 46.

The sections 54 and 56′ are provided in their upper portions just below the pipes 44 and 46 with thermostatic means in the form of feeler tubes 56 mounted in the walls of the diverter box and extending into the interior of the sections. The tubes are disposed within the sections so that they are passed over by the hot combustion gases as they enter the box and the cooler gases as they leave the box for passage through the pipe 46 to the chimney flue (not shown). The tubes have outer ends provided with indicating dials 58 which are located on the outside of the walls and give temperature readings to an observer.

The combustion end section 54 of the diverter box 12 is provided with a safety spill switch 60 which is tied into one leg of the conventional thermostat for the heating plant and which is activated to shut off the thermostat circuit which controls the gas flow to the main burner through the gas valve. The thermostat works through a high-limit control, a safety-pilot switch and then to the gas valve. When the gas valve is open, gas flows to the main burner where it is ignited by the pilot.

The safety switch operates under the high temperature of fumes or combustion products to prevent lethal carbon monoxide fumes from entering the building should the chimney flue be blocked. To protect the switch from being disinfluenced by cold air drafts, a shield or barrier plate 62 is arranged transversely between the side walls 18 and 20 at the open bottom 30 and transversely in between the openings 40 in the end walls. The shield is disposed below and spaced vertically from the lower free end of the baffle plate 52. The shield keeps cold air from contacting the safety switch and preventing it from functioning.

Figure 4:
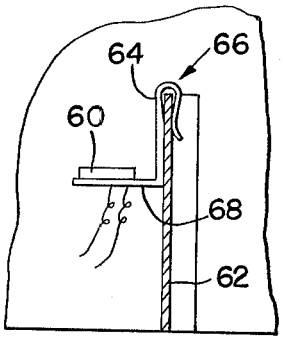
FIG. 4 is a fragmentary vertical sectional view taken on line 4—4 of FIG. 3.

As shown in FIGS. 3 and 4, the safety switch 60 is mounted one one leg 64 of a U-shaped member 66 which is removably fitted over the top edge of the barrier plate 62 that also serves as a brace member for the side walls of the diverter box 12. The member 66 preferably is a resilient clip. The leg 64 is positioned on the side of the plate 62 facing the combustion flue section 54 of the diverter box 12 and has a lateral flange 68 which is normal to the diverter box and on which the switch 60 is fixedly superimposed.

When installed, as shown in FIGS. 1 and 2, the elongate diverter box 12 has its bottom located just above or, at least, in the horizontal plane in which the factory box 36 lies so that the open bottom is positioned well above the base of the furnace. The box has its upper end portion located so that the pipes 44 and 46 come straight thereinto. Thus, there is a minimum of piping coming into and going out of the upper end of the diverter box 12 and such piping comes straight into and straight out of the box and lies in substantially the same horizontal plane.

Of course, while the preferred form of this invention has been described herein and shown in the attached drawing, it is to be understood that such is merely exemplary in nature and the scope of the invention is defined by the appended claims.

What is claimed is:

1. In combination with a gas-fired heating plant having a base, an upper portion and having a combustion chamber provided with a flue outlet disposed in the upper portion for the outlet passage of combustion gases to be conveyed to a chimney flue for the heating plant: a venting system for the combustion chamber comprising a first piping connected to the flue outlet, a second piping connected to the chimney flue, an elongate diverter box vertically positioned on the heating plant exteriorly thereof and having a first and second set of opposing vertical walls and having an upper portion with a top wall and a lower portion, said diverter box being connected to and intercommunicating both of said pipings at its upper portion which has opposing openings in one set of opposing vertical walls to accommodate the pipings, said diverter box having a bottom in its lower portion provided with a substantial opening disposed well above the base of the heating plant with said opening being in constant free communication with the atmospheric air surrounding the heating plant which air enters the diverter box through the opening in the bottom as cold air to establish a cold air pressure head below the first piping and establish a heat lock to prevent the flow of heated air from the combustion chamber outlet of the heating plant and also to prevent down drafts from the chimney flue attempting to pass down through the second piping from reaching the combustion chamber of the heating plant, and said diverter box having a heat resistant baffle plate disposed vertically thereof midway between the opposing vertical walls to which the pipings are connected.

2. The invention of claim 1 wherein said baffle plate has a lower free end disposed above the bottom of the diverter box which has an interior first vertical section communicated with the first piping and an interior second vertical section communicated with the second piping with cross flow of fumes being present therebetween from the first piping to the second piping below the lower free end of the baffle plate.

3. The invention of claim 2 including a safety limit switch housed in the first section and connected to the thermostat for the heating plant to control thereby the flow of gas to the main burners, the switch being activated by fumes from the outlet for the combustion chamber passing into the first end section through the first piping to shut off the fuel supply line.

4. The invention of claim 3 and including means protecting said switch from cold air down drafts from the chimney flue that would neutralize the action thereof.

5. The invention of claim 1 wherein said pipings are straight and lie in substantially the same horizontal plane as they enter the walls of the diverter box below the top wall.

6. The invention of claim 1 wherein said diverter box is substantially rectangular, said first set of vertical walls includes opposing end walls and said second set includes opposing side walls, said top wall being removable and having means for attaching it to the side and end walls of said openings for the pipings being provided in the side or end walls immediately below the top wall.

7. The invention of claim 6 wherein a brace plate is fixed within the diverter box between the side walls adjacent the bottom of the box.

8. The invention of claim 7 including a safety limit switch housed in the first section and connected to the thermostat for the heating plant to control thereby the flow of gas to the main burners, the switch being activated by fumes from the outlet for the combustion chamber passing into the first end section through the first piping to shut off the fuel supply line and a supporting means for said switch removably mounted on the brace plate.

9. The invention of claim 8 wherein said brace plate has a free upper edge and said switch supporting means includes a U-shaped member removably fitted over said edge and having a leg portion on which the switch is mounted.

* * * * *